US007114226B2

(12) United States Patent
Wizemann

(10) Patent No.: US 7,114,226 B2
(45) Date of Patent: Oct. 3, 2006

(54) NEEDLE FOR NEEDLING FLAT TEXTILE FABRICS

(75) Inventor: Gustav Wizemann, Messtetten (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/194,552

(22) Filed: Aug. 2, 2005

(65) Prior Publication Data

US 2006/0026810 A1 Feb. 9, 2006

(30) Foreign Application Priority Data

Aug. 4, 2004 (DE) ..... 10 2004 037 716

(51) Int. Cl.
*D04H 18/00* (2006.01)

(52) U.S. Cl. ..... 28/115

(58) Field of Classification Search ..... 28/115, 28/107, 108, 109, 110, 111, 112, 113, 114, 28/103, 162, 163, 165, 170; 112/222; 223/102; 289/16; 26/29 R, 30, 31, 36, 27, 28
See application file for complete search history.

(56) References Cited

U.S. PATENT DOCUMENTS

| | | | | |
|---|---|---|---|---|
| 469,762 | A | 3/1892 | Whipple | |
| 2,958,113 | A | 11/1960 | Lauterbach | |
| 3,224,067 | A | 12/1965 | Foster | |
| 3,566,663 | A * | 3/1971 | Zocher | 72/376 |
| 3,624,675 | A | 11/1971 | Foster | |
| 3,815,186 | A * | 6/1974 | Foster | 28/115 |
| 3,860,472 | A | 1/1975 | Derville | |
| 3,877,120 | A | 4/1975 | Okamoto et al. | |
| 3,913,189 | A | 10/1975 | Foster | |
| 3,972,096 | A * | 8/1976 | Ohotnicky | 28/115 |
| 3,975,565 | A | 8/1976 | Kendall | |
| 4,037,297 | A * | 7/1977 | Foster | 28/115 |
| 4,199,644 | A | 4/1980 | Platt | |
| 4,560,385 | A | 12/1985 | Baravian | |
| 4,674,271 | A * | 6/1987 | Bird | 57/2 |
| 4,818,586 | A | 4/1989 | Smith et al. | |
| 5,361,466 | A | 11/1994 | Robertson et al. | |
| 6,233,797 | B1 * | 5/2001 | Neely et al. | 28/115 |
| 6,839,945 | B1 * | 1/2005 | Irwin et al. | 28/107 |
| 2005/0251978 | A1 * | 11/2005 | Foster | 28/115 |

FOREIGN PATENT DOCUMENTS

| | | |
|---|---|---|
| DE | 1 760 440 | 12/1971 |
| DE | 25 18 066 | 11/1976 |
| DE | 195 21 796 C1 | 7/1996 |
| DE | 197 24 335 A1 | 1/1998 |

(Continued)

OTHER PUBLICATIONS

Informational Brochure of the Groz-Beckert company with delivery program attached, distributed at ITMA '95 on Oct. 18, 1995.

*Primary Examiner*—Amy B. Vanatta
(74) *Attorney, Agent, or Firm*—Fitch, Even, Tabin & Flannery; Norman N. Kunitz

(57) ABSTRACT

A needle (1) according to the invention serves for the after-treatment, particularly after-needling of flat textile products, particularly for roughening of the product surface. The needle (1) is of fully symmetrical construction with respect to the central longitudinal axis (11); this applies particularly also to its barbs. The needle gauge is at least 46 and the barb depth is 0.02 mm at the most. The needle ensures a gentle, protective operation and the making of particularly fine textiles.

12 Claims, 5 Drawing Sheets

FOREIGN PATENT DOCUMENTS

| | | |
|---|---|---|
| EP | 0 388 072 | 9/1990 |
| EP | 1 008 684 A1 | 6/2000 |
| EP | 1 072 724 A2 | 1/2001 |
| GB | 1 455 082 | 11/1976 |
| GB | 2 089 856 A | 1/1982 |
| GB | 2 315 281 A | 1/1998 |
| GB | 2 327 379 A | 1/1999 |

* cited by examiner

NEEDLE FOR NEEDLING FLAT TEXTILE FABRICS

CROSS REFERENCE TO RELATED APPLICATION

This application claims the priority of German Patent Application No. 10 2004 037 716.2, filed on Aug. 4, 2004, the subject matter of which, in its entirety, is incorporated herein by reference.

FIELD OF THE INVENTION

The invention relates to a needle intended for the after-treatment, particularly needling, of flat textile fabrics, such as felts, woven or knit products and the like. After-treatment may serve to provide the flat textile product with a different textile character, for example, to provide a velvety surface.

BACKGROUND OF THE INVENTION

Fabric needling for achieving roughening of one or both sides of a previously made flat textile fabric is known. For example, the article entitled *Needling Furnishing Fabrics and Woven Fabric-Reinforced Textiles* by Jürgen M. Strössner and Gustav Wizemann (ITB International Textile Bulletin, February 2003) deals with the roughening of fabrics by means of special needles for the gentle handling of fabrics. The needles have an oval, tear-shaped cross section and a longitudinally extending edge which is provided at a flank and which has one or more teeth for roughening the fabric. The dimension (gauge) of the needles is given as 38/40 which corresponds to a height or width of the cross section of the working part in excess of 0.4 mm.

Further, the above-noted article mentions needles having a triangular cross section of the working part for producing velour structures.

Also, for example, DE-OS 1 760 440 describes needles for felting purposes (so-called felting needles) which have a straight shank provided with a working part. The working part has, for example, a triangular or quadrilateral cross section, thus defining three or four lengthwise extending edges. Into the edges teeth are pressed which serve to felt with one another the fibers contained in the random-fiber product, to thus densify the product as the needles penetrate the random-fiber material. The barbs formed at the edges are staggered with respect to one another in the radial direction. They are relatively deep and have a portion which projects beyond the cross section of the shank. As a result, the barbs have a high felting efficiency. Such needles, however, are only poorly adapted, if at all, for the after-treatment of flat textile products, such as woven fabrics. They cause an excessive damage to the woven fabric and are thus overall unfit for this purpose.

DE-OS 25 18 066 describes a further felting needle serving to loop to one another individual fibers of a loose non-woven fabric by multiple needle penetration perpendicularly to the plane of the fabric for densifying the material. The main consideration in this connection is the fiber-entraining capacity which should be as high as possible. Also, the fibers, that is, the individual filaments should be damaged as little as possible. In at least one embodiment, the needle has a triangular cross section and is provided with barbs at the edges. The barbs are staggered with respect to one another. The barbs are of various embodiments: there are those which project beyond the outer contour of the of the working part, as well as those which do not.

DE 195 21 796 C1 too, describes a felting needle for needling a non-woven fiber fabric onto a carrier fabric. By means of needling, the non-woven fiber fabric is attached to the carrier fabric. The needle has a triangular cross section which is bounded by three longitudinally extending, flattened edges. The edges are provided with axially mutually staggered barbs which do not project beyond the outer contour and which have a depth of 0.01 to 0.04 mm, preferably 0.02 mm.

During penetration of a felting needle into a pre-reinforced non-woven material, in a felt or in a carrier fabric, significant longitudinal stresses on the felting needle may be generated. The slimmer the felting needle, the more critical the longitudinal stresses. For the after-treatment of textile material, for example, for roughening, however, as a rule particularly fine needles of a very small cross section should be used. Because of the slender construction of the working part of such a needle, a certain flexibility thereof has to be taken into account. Also, upon penetration of the needles into the fabric, a certain lateral excursion of the needles is to be expected. It is a desideratum that such excursions do not occur in an uncontrolled manner. Needle breakages are particularly disadvantageous. Broken-off working parts impermissibly damage the fabric. Therefore, conventional slender needles cannot be readily made even slimmer.

SUMMARY OF THE INVENTION

Based on the above, it is therefore an object of the invention to provide an after-treatment needle for flat textile fabrics, by means of which a pile-like, hairy surface may be formed on the fabric and which does not cause impermissible damage to the fabric while operating at high speed and with great reliability. This object is achieved with the after-treatment needle as defined in claim 1:

The needle according to the invention has, for example, a triangular or rectangular cross section which, because of the particularly slender construction of its working part, has a dimension of 0.35 mm (gauge 46) or less. In case of a triangular cross section, the height of the working part corresponds to the height of the triangle. In case of a star-shaped cross section, the height of the working part is measured along all the four edges. At least at two edges adjoining barbs are arranged, whose depth is 0.02 mm or less. Preferably all edges are provided with such barbs, in which case the barbs lie on a circle which is concentric with the central longitudinal axis of the working part or they lie on a helix, whose pitch is less than three times the axial length of one barb. Preferably, the pitch is even less than twice the axial length of one barb. By virtue of such a measure, in combination with the small depth of the barbs, a unilateral, asymmetrical weakening of the working part which may occur in case of staggered barbs, is avoided. Thus, upon penetration of the slender after-treatment needles into a firm fabric or a pre-densified non-woven fabric, no uncontrolled lateral kinking of the working parts of the individual needles can occur. Accordingly, the working speed may be increased, while the needle displays a capacity of undergoing high stresses. On the other hand, the barbs lying on a common crown cause a certain weakening of the working part in the sense that one location will have an increased elasticity. The after-treatment needle is therefore less prone to needle breakages caused by a lateral stretch of the flat textile product.

Because of their small width of merely 0.35 mm or less, the cross-sectional shape of the after-treatment needles cannot be readily derived by simply scaling down the needle cross sections of coarser needles. Rather, the radii of curvature at the longitudinal edges have to be adapted in relation to the cross section, so that they do not form sharp edges that would sever the threads. The radii of curvature of the longitudinally extending edges are preferably greater than one third of the radius of a circumscribable circle about the cross section of the working part of the needle. By a "circumscribable circle" there is meant here a circle, whose center lies on the central longitudinal axis of the working part and which touches the edges of the working part. In a further preferred embodiment the radii of the edges are greater than one half the radius of the circle circumscribable about the cross section of the working part of the needle. A needle is obtained which has the capacity to undergo great stresses, which is rigid, yet very slender and which causes very little damage to the fabric.

Preferably, the tip of the needle body at that end of the working part which is oriented away from the clamping part, is substantially point-like; its radius of curvature is preferably below 0.01 mm. The needle body adjoining the tip is preferably uniformly curved and has neither barbs, nor facets or the like. As a result, the needle penetrating through a fabric may pierce through individual yarns without laterally displacing them. This reduces, on the one hand, stresses on the needle and, on the other hand, a lateral stretch of the fabric. Further, damage to the yarns is avoided.

The barbs are preferably structured in such a manner that no part thereof projects beyond the external outline of the working part as defined by the circumscribable circle. Likewise, preferably no part projects beyond the cross-sectional outline proper of the working part. The barbs are rounded where they join the working part. The radius of curvature of the barbs is preferably greater than the radius of curvature of the longitudinally extending edges and is preferably the same as, but not greater than, the radius of the circumscribable circle. As a result of this feature, in combination with the small depth of the barbs, a cross section in the region of the three barbs lying at the same height is reduced by less than 10%.

Further details of advantageous embodiments of the invention are disclosed in the drawing, the specification or the claims.

The drawing illustrates several embodiments of the invention.

DETAILED DESCRIPTION OF THE INVENTION

Figure 1:
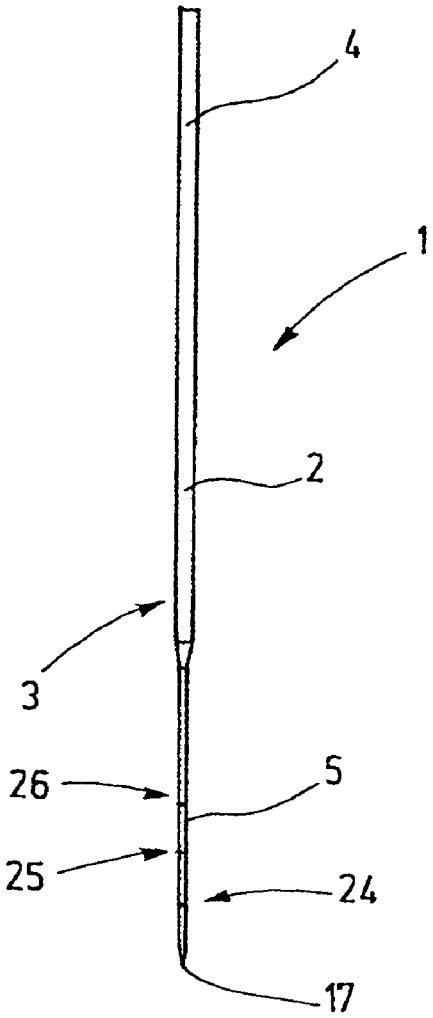
FIG. 1 is an enlarged side elevational view of an after-treatment needle according to the invention.

FIG. 1 shows a needle 1 serving as an after-treatment needle, whose needle body 2 has a straight shank 3, provided at one end with a clamping part 4 which may be cylindrical. At the opposite end of the shank 3 a working part 5 is formed which constitutes a one-piece component with the clamping part 4.

The working part 5 is of particularly slender configuration. In the present embodiment it has a triangular cross section, whose height is 0.35 mm or less. The length of the working part 5 is, however, at least preferably, in excess of 10 mm. Also referring to FIG. 4, on the working part several edges 6, 7 and 8 are formed, each having a radius of curvature R which is preferably of identical size for each edge 6, 7 and 8. The radius of curvature is at least of such a size that the edges 6, 7 and 8 cannot be considered as sharp and thus, during rapid penetration of the working part into a woven fabric, felt or other flat textile product, the edges are not capable of severing filaments or even threads, for example, yarns. The radius of curvature R is preferably greater than at least one third of the radius Ru of a circumscribable circle 9 which is shown in broken lines in FIG. 4 and which touches all three edges 6, 7 and 8. The circumscribable circle 9 is concentric with an imaginary central longitudinal axis 11 of the working part 5.

Figure 4:
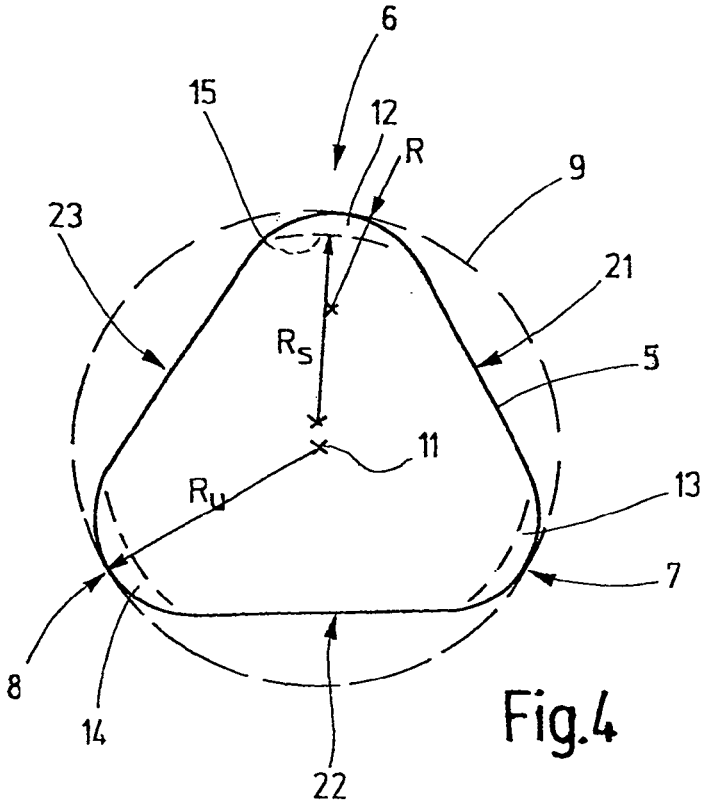
FIG. 4 is a schematic illustration of a cross section of a first embodiment of a working part of a needle according to the invention.

The cross section shown in FIG. 4 has, as defined by its circumscribable circle 9, a lateral dimension which is less than the lateral dimension of the cross section of conventional felting needles. The distance of the edges 6, 7; 7, 8; 8, 6 from one another is regarded as the cross-sectional width or cross-sectional height and is preferably 0.35 mm or less. In this manner the extremely fine needle 1 according to the invention leaves barely visible punctures on the side facing the needles or on the carrier side.

Figure 2:
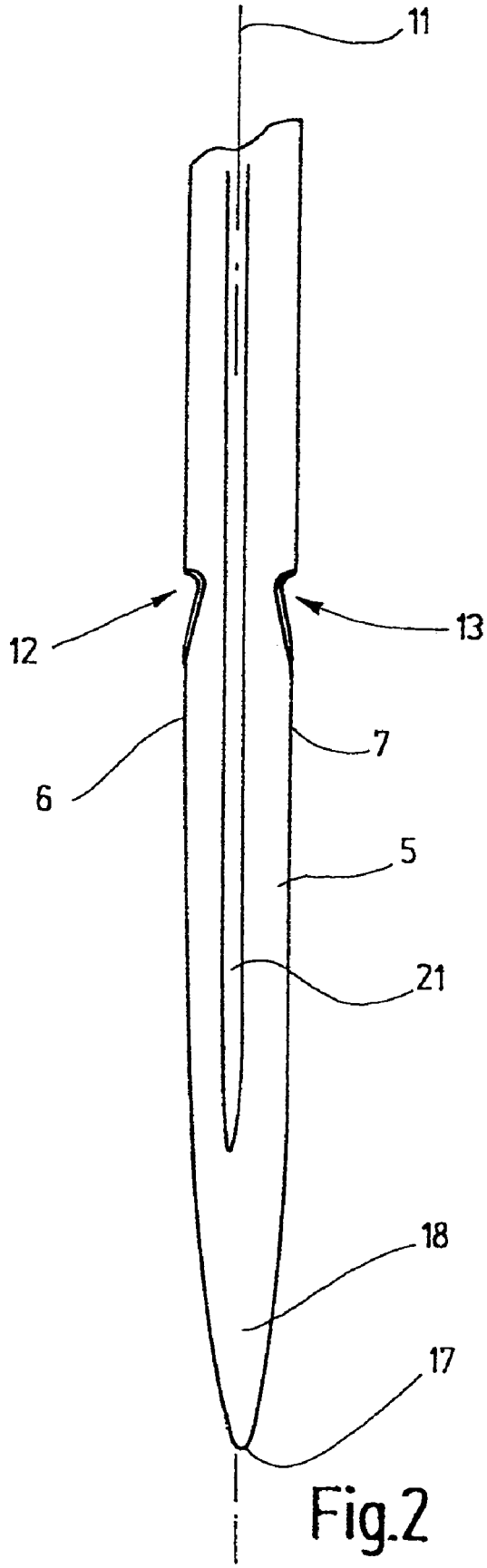
FIG. 2 is a substantially enlarged, fragmentary side elevational view of the needle of FIG. 1.
Figure 3:
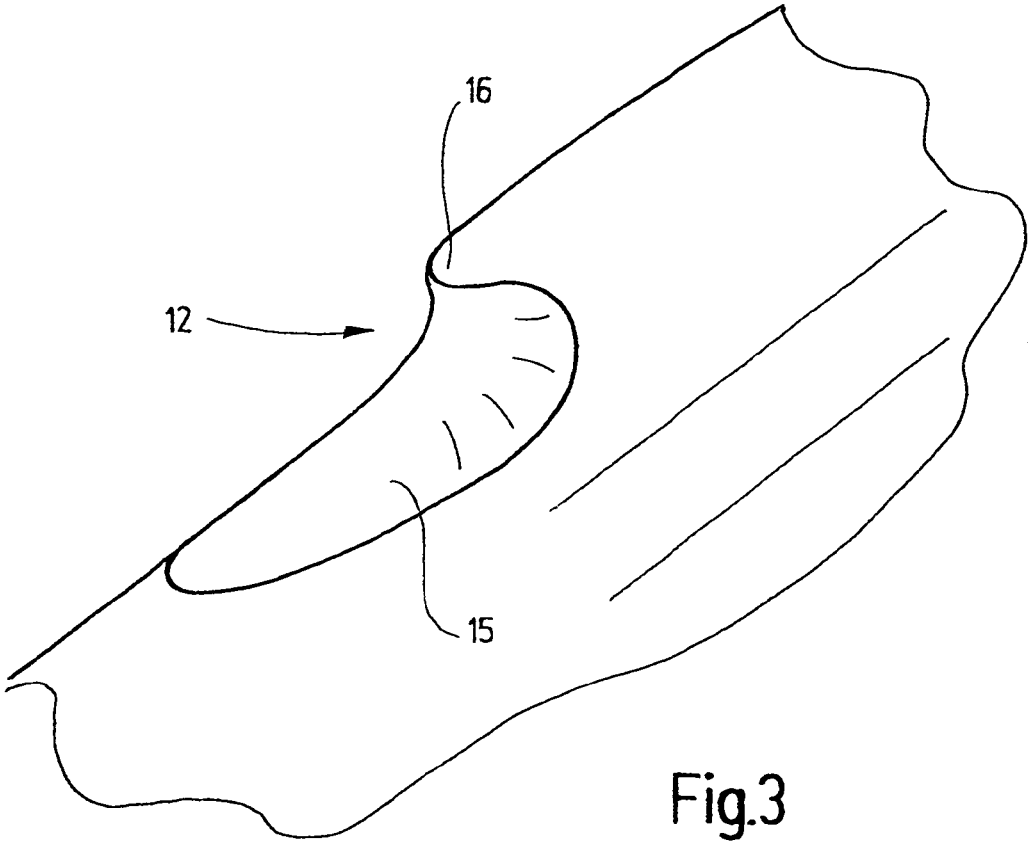
FIG. 3 is a fragmentary perspective view of the needle of FIGS. 1 and 2.

The needle 1 has barbs 12, 13, 14 which are seen particularly in FIGS. 2, 3 and 4 and which, as indicated in FIG. 2 for the barbs 12 and 13, are in identical axial positions as related to the central longitudinal axis 11. The barbs lie on a common circle or crown about the central longitudinal axis 11 and are of identical construction. For a more detailed illustration, the barb 12 is separately shown in FIG. 3. It has an asymmetrical saddle surface 15 which forms a tooth 16 at its end oriented toward the clamping part 4. The tooth 16 has no portion which projects beyond the outer contour. In FIG. 4 the outer contour is formed by the triangle which bounds the cross section and which has rounded corners. The depth of the barb 12 preferably equals to or is less than 0.02 mm. The saddle surface 15 is, according to FIG. 4, shown in its section at its deepest location indicated by shade lines. The radius of curvature Rs of the saddle surface may be about equal to the radius of curvature of the circumscribable circle 9. The center of the radii of curvature of the saddle surfaces of the triangular barbs 6, 7, 8 are situated about the central axis 11 in the vicinity of the center, that is, within a region of, for example, 0.1 mm about the central axis 11.

The barbs 12, 13, 14 are arranged from a tip of the working part 5 at a distance which is preferably a few millimeters and is, for example, in the range of 2 to 5 mm. The tip is a point, preferably in the literal sense, since its radius of curvature is 1/100 mm at the most. This sharp point 17 is adjoined by the outer surface of the tip region 18 which is free from edges, facets or similar geometrical elements; it is smooth, that is, in particular, it is edge-free. The planar lateral surfaces 21, 22, 23 of the working part 5 which has an approximately triangular cross section, gradually terminate on the tip region 18, as illustrated in FIG. 2 for the lateral surface 21.

Apart from the barb crown 24 formed by the barbs 12, 13, 14, the same type of barbs may form further barb crowns 25, 26 as shown in FIG. 1 in order to pull out, during a single puncturing, a greater number of velvet threads from the plane of the woven fabric. The barb crowns 24, 25, 26 function to a slight extent as resilient locations which allow a lateral flexible yield of the slender working part 5 without damage thereto. Furthermore, the barb crowns symmetrize the forces during penetration of the slender working part even into a firm fabric, thus preventing a lateral kinking of the working part 5.

Figure 5:
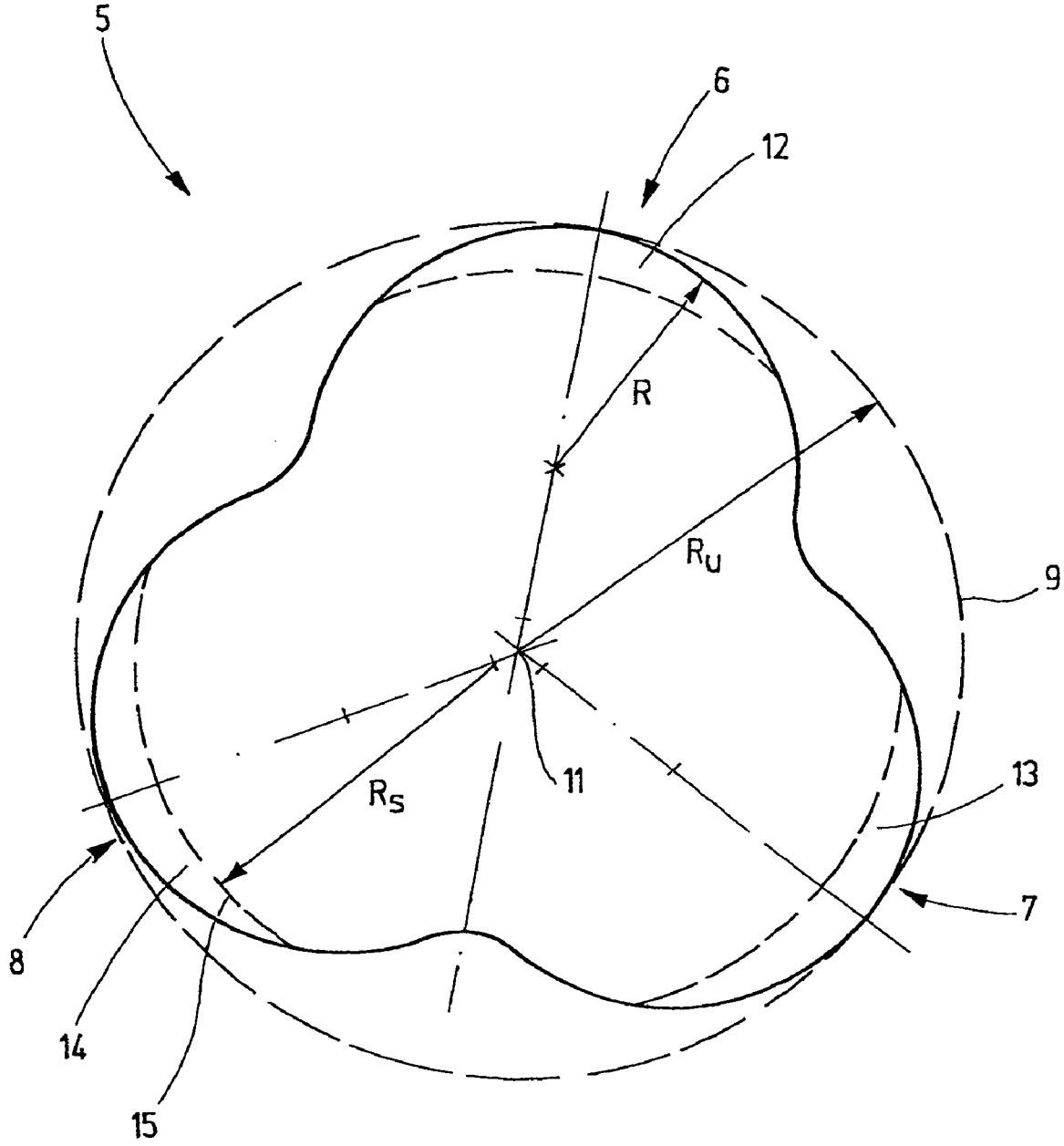
FIG. 5 is a schematic illustration of a cross section of another embodiment of a working part of a needle according to the invention.

FIG. 5 shows the cross section of a modified embodiment of the needle 1. The cross section has, in a very general sense, a star shape, in which the individual lobes of the star are externally rounded with a large radius of curvature R. As a result, the edges 6, 7, 8 are not sharp despite the substantial fineness of the working part 5. The latter has a gauge size 46 which is in contrast to a maximum gauge size 43 characterizing conventional felting needles. Therefore, the diameter of the circumscribable circle 9 does not exceed 0.35 mm, and thus its radius Ru does not exceed 0.175. The radius of curvature R is preferably greater than 0.05 mm, but even more preferably greater than 0.06 mm. According to a particularly preferred embodiment, the radius is greater than 0.09 mm, that is, greater than one half the radius Ru. As a result, on the on the hand, particularly small punctures may be obtained and, on the other hand, yarn damages are avoided even at high working speeds. Further, the earlier-noted considerations apply here as well, that is, the individual barbs 12, 13, 14 have a depth of 0.02 mm at the most and no tooth portions project beyond the outer contour of the cross section, not even beyond the circumscribable circle 9. The saddle surface 15 of each barb 12, 13, 14 has a radius Rs between 0.1 and 0.175 mm. The center of curvature lies preferably on the longitudinal central axis 11 or in the vicinity thereof. It lies preferably in a region which surrounds the central axis 11 and whose radius is less than 0.05 mm.

Figure 6:
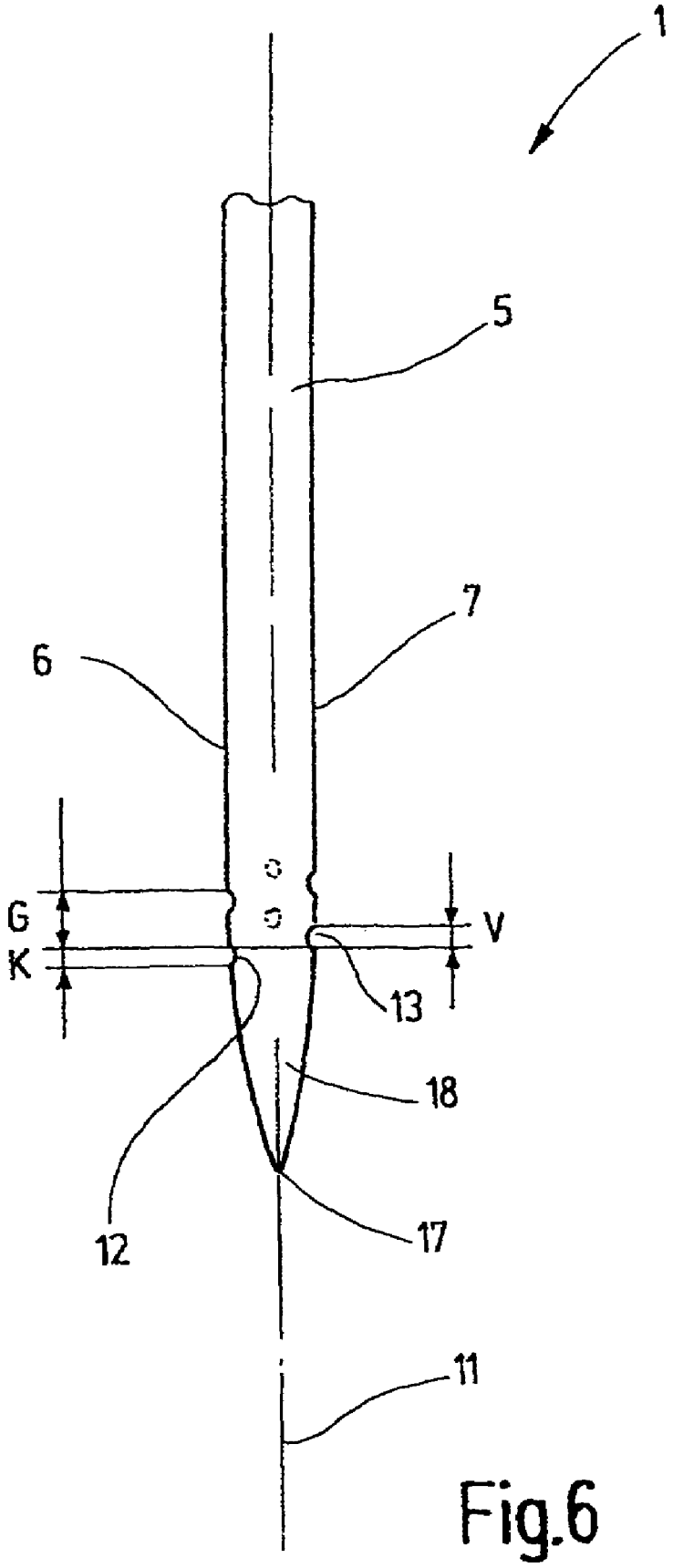
FIG. 6 is a schematic side elevational view of a modified embodiment of a needle according to the invention.

FIG. 6 illustrates a further embodiment of the needle 1, whose working part 5 may have a triangular cross section according to FIG. 2 or a star-shaped cross section according to FIG. 5. The barbs 13, 13 and additional, non-illustrated barbs have identical lengths in the axial direction and are of identical construction in other respect as well. They have a length of preferably $^{12}/_{100}$ at the most. The barbs 12, 13 which adjoin one another on a helical line, are staggered in the axial direction. The offset V is in the range of $^{10}/_{100}$ to $^{7}/_{100}$ and is slightly less than the length K of each barb which preferably amounts to about $^{12}/_{100}$ mm. Thus, the distance between adjoining barbs on a common edge 6 is, for example, $^{30}/_{100}$ at the most. In a needle having four edges, the distance is then maximum four times the offset, that is, $^{40}/_{100}$ at the most. Such a distance is identical to the pitch G of the helix on which the barbs are arranged. Thus, the pitch G is equal to or less than three times the length K of each barb. The pitch G is preferably even less than twice the length K. In case the axial distance of the barbs 12, 13 and the axial distance of further barbs following on the helix is only $^{7}/_{100}$ mm, then the pitch G of a working part having a triangular cross section is by $^{21}/_{100}$ mm less than twice the barb length of $^{12}/_{100}$ mm.

In the helical barb configuration shown in FIG. 6 the barbs form, about the working part 5, an annular zone which is altogether shorter than 1 mm and whose distance from the tip 17 is preferably about 2 mm. Above and below this region the working part 5 is preferably smooth. The limitation of the barbs to a narrow, annular region, and the smooth configuration of the working part 5 above and below this region are advantageous in all other embodiments as well. It has been found that with such needles a particularly gentle after-treatment process is feasible. In particular, the needles need not penetrate very deeply into the woven or knit fabric or other textile material. The friction between the edges 6, 7 and the fibers is reduced to a minimum. This opens the way for rendering the needles even more slender. By concentrating the barbs to a short working region which has a length less than 1 mm and which is situated in the immediate vicinity of the tip 17, a short-stroke operation of the needles 1 is feasible. This reduces the danger that the sharpening of the edges 6, 7 due to additionally slimming of the working part 5 will damage the threads of the flat textile product.

The needle according to the invention is utilized, for example, for an after-needling of woven or knit fabrics. The after-needling lends the flat textile product at least some of the following properties:

- a softer textile character,
- a pile-like, hairy surface,
- an improved comfort of wear—a softer material may be formed,
- a significantly reduced fraying,
- a higher dimensional stability,
- a higher resistance to tearing,
- a higher progressive tearing force, by which is meant a force necessary to further tear a textile material provided with a cut.

In addition, as a result of the surface treatment, the bonding strength with a coating material, for example, Latex, is increased.

Based on the fineness of the needle 1 according to the invention, having a gauge of at least 46, and the small depth of the barbs of only 0.02 mm, the danger of yarn or fiber damage is reduced to a minimum. Material stretch and large punctures are thereby avoided. The arrangement of the barbs at least pair-wise or in groups of three at the same height symmetrizes the forces appearing in the particularly slender needle 1 and avoids kinking during rapid operation or in case of heavy fabrics.

Figure 7:
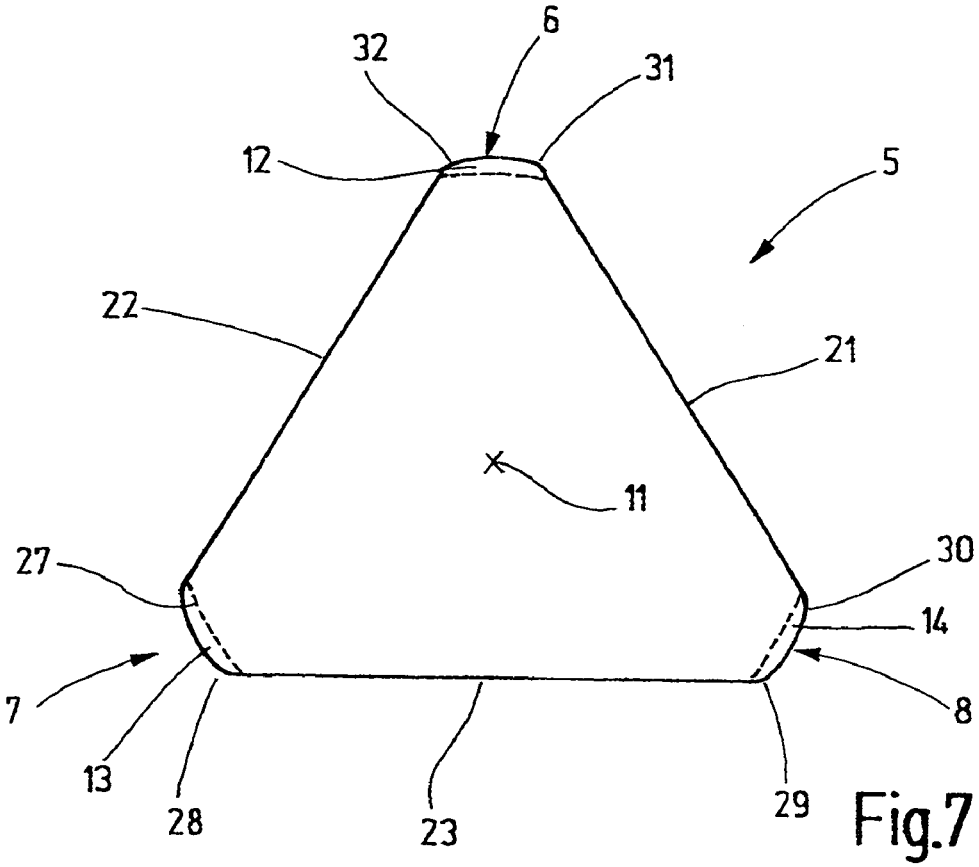
FIG. 7 is a schematic illustration of a cross section of an embodiment of the working part of a needle according to the invention.
Figure 8:
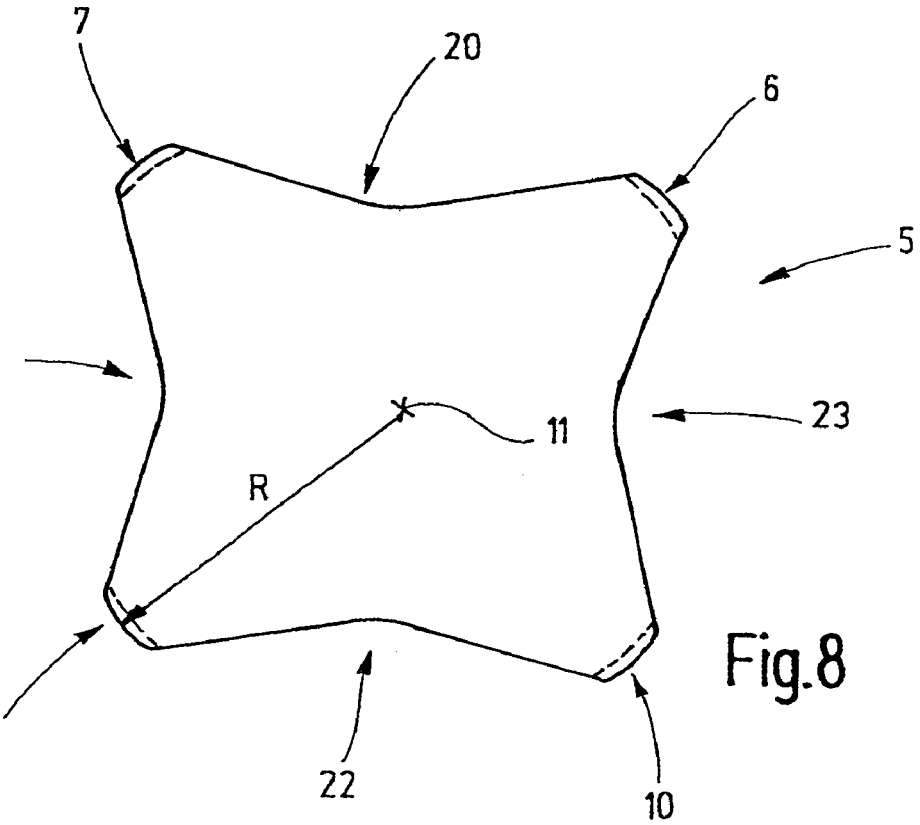
FIG. 8 is a schematic illustration of a cross section through a four-edge working part of a needle according to the invention.

FIGS. 7 and 8 illustrate further preferred cross-sectional configurations of the working part 5. The working part 5 according to FIG. 7 has three edges 6, 7, 8 which are flattened to such an extent that, as viewed from the outside, they appear as narrow strips. Their radius of curvature R is preferably greater than their distance from the central longitudinal axis 11. A substantially infinite radius of curvature is also a possibility, in which case flat strips are obtained. Between the strip-shaped edges 6, 7, 8 planar lateral faces 21, 22, 23 are arranged. The transitions between the lateral faces 21, 22, 23 and the edges 6, 7, 8 are formed by line-shaped edge regions, that is, by kinked edges 27, 28, 29, 30, 31, 32. The barbs 12, 13, 14 are shown in broken lines in FIG. 7. As concerns their depth and arrangement, the earlier considerations apply.

The working part 5 shown in FIG. 8 has a four-edged construction. Its edges 6, 7, 8, 10 are arranged at the corners of a star. The radius R of the strip-shaped edges is preferably as large as, or greater than, the distance from the central longitudinal axis 11; it may be, however, of infinite size. If required, the edges 6, 7, 8, 10 may be rounded. The lateral surfaces 20, 21, 22, 23 lying pair-wise between the edges 6, 7, 8, 10 define concave outer sides. In a preferred embodiment they are formed in each instance of two strip-shaped surface regions arranged at an obtuse angle to one another. In a particular embodiment the outer sides have a straight surface region which is not curved. All four edges 6, 7, 8, 10 are provided with barbs arranged on a helix of small pitch which is preferably less than four times the axial length of one barb.

A needle 1 according to the invention serves for the after-treatment, particularly after-needling of flat textile products, particularly for roughening of the product surface. The needle 1 is of fully symmetrical construction with respect to the central longitudinal axis 11; this applies particularly also to its barbs 12, 13, 14. The needle gauge is at least 46 and the barb depth is 0.02 mm at the most. It ensures a gentle, productive operation and the making of particularly fine textiles.

It will be appreciated that the above description of the present invention is susceptible to various modifications, changes and adaptations, and the same are intended to be comprehended within the meaning and range of equivalents of the appended claims.

List of Reference Characters

| | |
|---|---|
| 1 | needle |
| 2 | needle body |
| 3 | shank |
| 4 | clamping portion |
| 5 | working part |
| 6, 7, 8, 10 | edges |
| 9 | circumscribable circle |
| 11 | central longitudinal axis |
| 12, 13, 14 | barbs |
| 15 | saddle surface |
| 16 | tooth |
| 17 | tip |
| 18 | tip region |
| 20, 21, 22, 23 | lateral surfaces |
| 24, 25, 26 | barb crowns |
| 27, 28, 29, 30, 31, 32 | kinked edges |
| G | pitch |
| K | length |
| V | offset |
| R | radius of curvature |
| Ru | radius of circumscribable circle |
| Rs | radius of curvature of saddle surface |

What is claimed is:

1. An after-treatment needle (1) for flat textile products, comprising an axially elongated needle body (2) having at one end a clamping part (4) and at another end a working part (5) provided with n number of edges (6, 7, 8, 10) extending in the axial direction of the needle body (2) and having a cross-sectional height of less than 0.35 mm, wherein n equals to or is greater than three, and adjoining barbs (12, 13) arranged at least at two edges (6, 7); the adjoining barbs (12, 13) have a depth which is less than 0.02 mm and are arranged pair-wise in the same axial position or on a helical line, whose pitch (G) is less than n times the length of the barb (12).

2. The after-treatment needle as defined in claim 1, characterized in that the pitch (G) is less than twice the length of the barb (12).

3. The after-treatment needle as defined in claim 1, characterized in that the working part (5) has a star-shaped cross section.

4. The after-treatment needle as defined in claim 1, characterized in that the working part (5) has a three-edged or a four-edged cross section.

5. The after-treatment needle as defined in claim 1, characterized in that the edges (6, 7, 8, 10) are rounded.

6. The after-treatment needle as defined in claim 5, characterized in that the radius of curvature (R) of the edges (6, 7, 8) is greater than one third of the radius (Ru) of a circumscribable circle about the cross section of the working part (5) of the needle (1).

7. The after-treatment needle as defined in claim 5, characterized in that the radius of curvature (R) of the edges (6, 7, 8) is greater than one half of the radius (Ru) of a circumscribable circle about the cross section of the working part (5) of the needle (1).

8. The after-treatment needle as defined in claim 1, characterized in that the needle body (2) has a substantially point-shaped tip (17) at the end remote from the clamping part (4).

9. The after-treatment needle as defined in claim 8, characterized in that the tip (17) is edge-free.

10. The after-treatment needle as defined in claim 1, characterized in that all the edges (6, 7, 8) are provided with barbs (12, 13, 14), and the barbs (12, 13, 14) are arranged in annular or crown-shaped regions.

11. The after-treatment needle as defined in claim 1, characterized in that the barbs (12, 13, 14) are provided with a curvature about the central longitudinal axis (11) of the working part (5); the radius (Rs) of the curvature is less than the radius (Ru) of a circumscribable circle containing the cross section of the working part (5).

12. The after-treatment needle as defined in claim 1, characterized in that the edges (6, 7, 8, 10) are formed by planar, strip-shaped surface regions.

* * * * *